US011636795B1

(12) United States Patent
Huang et al.

(10) Patent No.: US 11,636,795 B1
(45) Date of Patent: Apr. 25, 2023

(54) METHOD OF PROVIDING DISPLAY SIGNAL, RESOLUTION SETTING DEVICE AND DISPLAY SYSTEM

(71) Applicant: WISTRON CORP., New Taipei (TW)

(72) Inventors: Po-Yen Huang, New Taipei (TW); Kuang Wei Wang, New Taipei (TW); Tzu-Chieh Lee, New Taipei (TW); Yen-Hsiang Wang, New Taipei (TW); Ching-Ting Huang, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 17/935,143

(22) Filed: Sep. 26, 2022

(30) Foreign Application Priority Data

Jun. 7, 2022 (TW) ..... 111120961

(51) Int. Cl.
*G09G 3/20* (2006.01)

(52) U.S. Cl.
CPC ..... *G09G 3/20* (2013.01); *G09G 2330/026* (2013.01); *G09G 2340/0407* (2013.01)

(58) Field of Classification Search
CPC ..... G09G 3/20; G09G 2330/026; G09G 2340/0407
See application file for complete search history.

(56) References Cited

U.S. PATENT DOCUMENTS

2007/0030295 A1 2/2007 Chen
2020/0242990 A1* 7/2020 Ren ..... G09G 3/3655
2020/0243039 A1* 7/2020 Han ..... G09G 5/006

FOREIGN PATENT DOCUMENTS

TW 200707271 A 2/2007

OTHER PUBLICATIONS

TW Office Action dated Dec. 7, 2022 in Taiwan application No. 111120961.

* cited by examiner

*Primary Examiner* — Sejoon Ahn
(74) *Attorney, Agent, or Firm* — McClure, Qualey & Rodack, LLP

(57) ABSTRACT

A method of providing display signal, performed by a first processing device, and the method includes: triggered by a first detection signal to read first identification data of a display, obtaining second identification data according to a reading condition, outputting a second detection signal to a second processing device to obtain an identification data request signal from the second processing device, and outputting the second identification data to the second processing device according to the identification data request signal to instruct the second processing device to output a display signal to the display according to a resolution indicated by the second identification data. The present disclosure further provides a resolution setting device and a display system.

20 Claims, 7 Drawing Sheets

METHOD OF PROVIDING DISPLAY SIGNAL, RESOLUTION SETTING DEVICE AND DISPLAY SYSTEM

CROSS-REFERENCE TO RELATED APPLICATIONS

This non-provisional application claims priority under 35 U. S.C. § 119(a) on Patent Application No(s). 111120961 filed in Republic of China (ROC) on Jun. 7, 2022, the entire contents of which are hereby incorporated by reference.

BACKGROUND

1. Technical Field

This disclosure relates to a method of providing display signal, resolution setting device and display system, particularly to a method of providing display signal, resolution setting device and display system operate according to identification data of a display.

2. Related Art

Currently, there are many types of display interfaces on the market, such as display port (DP), high definition multimedia interface (HDMI), or digital visual interface (DVI).

In order to be adapted to a variety of connection port types, various types of adapters exist on the market (for example, dongle), which are used to provide connection between a high definition multimedia interface or a digital visual interface and a display interface of an external monitor. However, when using these adapters, it is common for the external monitor to fail to display or to display discontinuous content.

SUMMARY

According to one or more embodiment of this disclosure, a method of providing display signal, performed by a first processing device, and the method includes: triggered by a first detection signal to read first identification data of a display, obtaining second identification data according to a reading condition, outputting a second detection signal to a second processing device to obtain an identification data request signal from the second processing device, and outputting the second identification data to the second processing device according to the identification data request signal to instruct the second processing device to output a display signal to the display according to a resolution indicated by the second identification data.

According to one or more embodiment of this disclosure, a resolution setting device includes a processing circuit and a storage circuit. The processing circuit is configured to be triggered by a first detection signal to read first identification data of a display and obtain second identification data according to a reading condition, and output a second detection signal to a processing device. The storage circuit is connected to the processing circuit, and is configured to receive the second identification data from the processing circuit and store the second identification data, obtain an identification data request signal in response to the second detection signal from the processing device, and output the second identification data to the processing device according to the identification data request signal, for the processing device to output a display signal to the display according to a resolution indicated by the second identification data.

According to one or more embodiment of this disclosure, a display system includes a display, a first processing device, and a second processing device. The display is configured to display a display content according to a display signal. The first processing device is connected to the display, and is configured to be triggered by a first detection signal to read first identification data of a display and obtain second identification data according to a reading condition, output a second detection signal to obtain an identification data request signal in response to the second detection signal, and output the second identification data according to the identification data request signal. The second processing device is connected to the display and the first processing device, and is configured to output the identification data request signal to the first processing device according to the second detection signal, read the second identification data from the first processing device, and output the display signal to the display according to a resolution indicated by the second identification data.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. According to the description, claims and the drawings disclosed in the specification, one skilled in the art may easily understand the concepts and features of the present invention. The following embodiments further illustrate various aspects of the present invention, but are not meant to limit the scope of the present invention.

Figure 1:
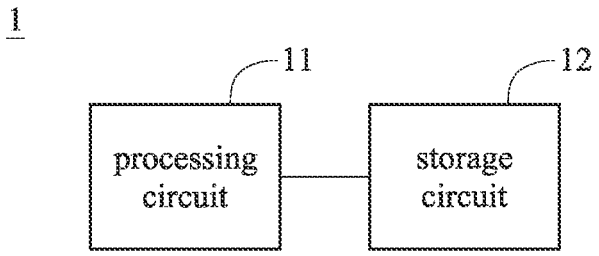
FIG. 1 is a block diagram illustrating a resolution setting device according to an embodiment of the present disclosure.

Please refer to FIG. 1, wherein FIG. 1 is a block diagram illustrating a resolution setting device according to an embodiment of the present disclosure. The resolution setting device 1 includes a processing circuit 11 and a storage circuit 12, wherein the processing circuit 11 and the storage circuit 12 may be separately disposed, and the processing circuit 11 may be directly electrically connected to the storage circuit 12 through an inter-integrated circuit ($I^2C$) bus. Or, the resolution setting device 1 may be a microcontroller unit (MCU), and the processing circuit 11 and the storage circuit 12 may be disposed in said microcontroller unit together, wherein the processing circuit 11 may be a central processing unit of the microcontroller unit, and the storage circuit 12 may be a memory of the microcontroller unit, such as electrically-erasable programmable read-only memory (EEPROM). In a scenario where the display is connected to a computer, the resolution setting device 1 may be disposed outside of the computer or disposed in the computer, and may be directly or indirectly connected between a processing device (for example, a central processing unit) of the computer and the display to solve the problem of an external display not being able to display contents corresponding to a display signal received from the computer through an adapter (for example, dongle).

Figure 2:
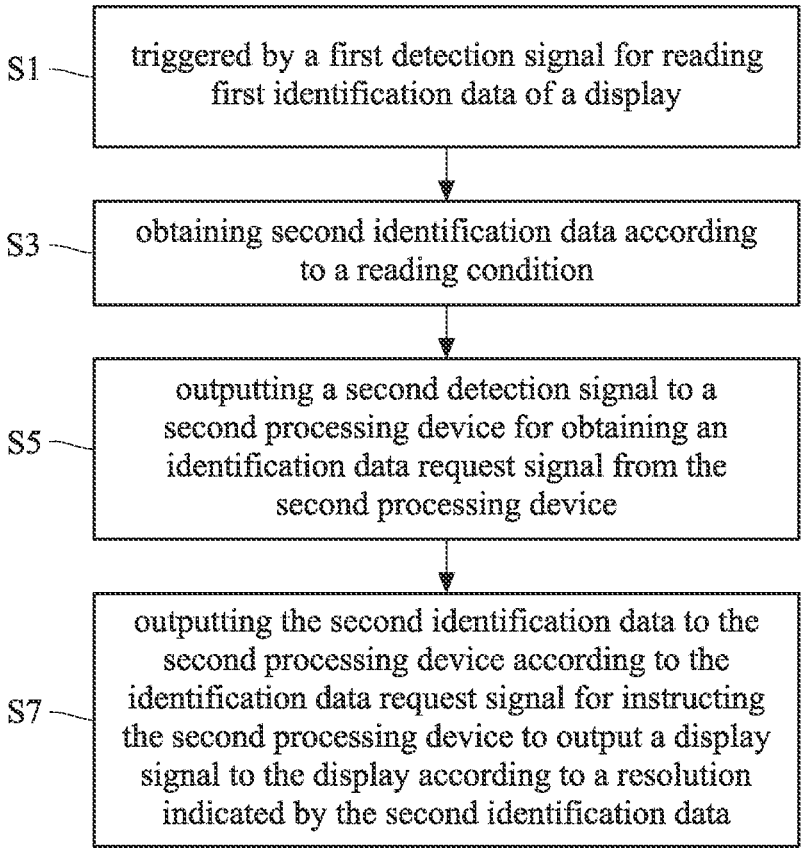
FIG. 2 is a flowchart illustrating a method of providing display signal according to an embodiment of the present disclosure.

Please refer to FIG. 1 and FIG. 2, wherein FIG. 2 is a flowchart illustrating a method of providing display signal according to an embodiment of the present disclosure. The method of providing display signal shown in FIG. 2 is performed by the resolution setting device 1 (referred to as "first processing device" hereinafter) with the display and a processing device (for example, a processing device such as CPU or GPU of the computer, referred to as "second processing device" hereinafter) for generating display signal. The method of providing display signal of an embodiment of the present disclosure, as shown in FIG. 2, includes, by the first processing device 1, performing: step S1: triggered by a first detection signal for reading first identification data of a display; step S3: obtaining second identification data according to a reading condition; step S5: outputting a second detection signal to a second processing device for obtaining an identification data request signal from the second processing device; step S7: outputting the second identification data to the second processing device according to the identification data request signal for instructing the second processing device to output a display signal to the display according to a resolution indicated by the second identification data.

In step S1 and step S3, the first detection signal may come from the external display, the generation of the first detection signal indicates the display is already directly or indirectly (for example, via dongle) connected to the second processing device of the computer through digital display interface (DDI). Therefore, the processing circuit 11 reads the first identification data of the display and obtains the second identification data according to the reading condition, wherein the first detection signal may come from said external display, or the first processing device 1 may include physical or virtual button to be triggered by a user to generate the first detection signal. In step S5 and S7, the processing circuit 11 outputs the second detection signal to the second processing device to obtain the identification data request signal, and the storage circuit 12 outputs the second identification data to the second processing device according to the identification data request signal, to instruct the second processing device to output the display signal to the external display according to the resolution indicated by the second identification data, wherein the identification data request signal is used to request identification data supported by the display from the first processing device 1.

Further, the detection signal described herein may be hot plug detection (HPD) signal; the identification data described herein may be extended display identification data (EDID), including the resolution supported by the display, manufacturer name of the display and serial number of the display etc. The identification data is used to instruct the second processing device to provide the display signal with the resolution supported by the external display.

Generally, common adapters include dongle used for connecting the display port (DP) of the computer (for example, a computer disposed with said second processing device) to high definition multimedia interface (HDMI) or digital visual interface (DVI) etc. of the external display. However, even if a dongle is used, it is still possible that the display is unable to display normally. Through embodiments shown in FIG. 1 and FIG. 2, even if an adapter is installed on the external display but the adapter is not compatible with the display or the computer, the display may still display content corresponding to the display signal outputted by the computer at the resolution supported by the display.

Figure 3:
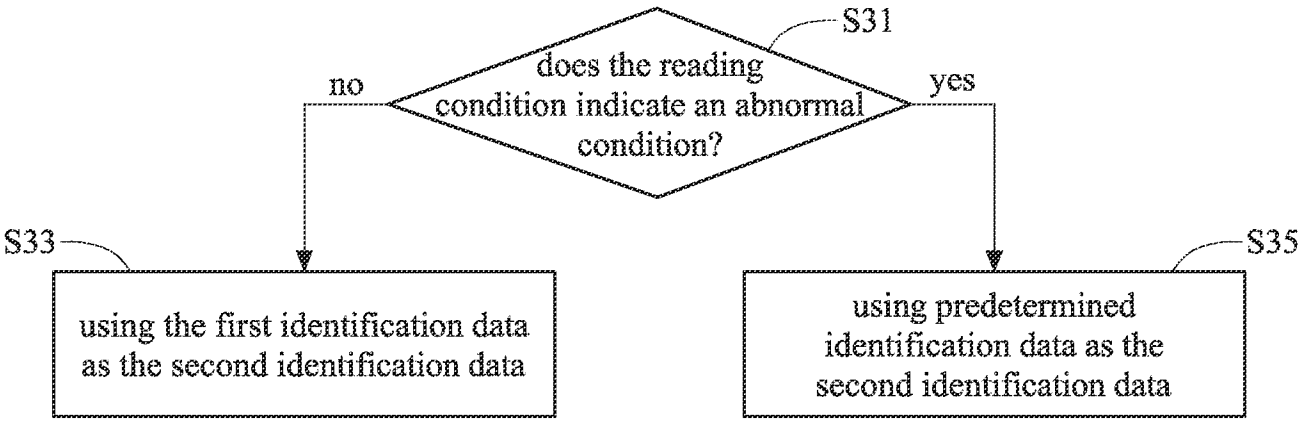
FIG. 3 illustrate detail flowchart of step S3 of FIG. 2.

Please refer to FIG. 1 and FIG. 3, wherein FIG. 3 illustrate detail flowchart of step S3 of FIG. 2. As shown in FIG. 3, step S3 may include: step S31: determining whether the reading condition indicates an abnormal condition; if the reading condition does not indicate the abnormal condition, performing step S33: using the first identification data as the second identification data; and if the reading condition indicates the abnormal condition, performing step S35: using predetermined identification data as the second identification data.

When the processing circuit 11 reads the first identification data of the display through the inter-integrated circuit bus, the processing circuit 11 may determine whether the reading condition indicates the abnormal condition, wherein the abnormal condition may include: the processing circuit 11 not being able to read the first identification data from the display; or the processing circuit 11 determining the processing circuit 11 not being able to recognize the first identification data, for example, the processing circuit 11 of the first processing device 1 not being able to recognize the resolution indicated by the first identification data. If the reading condition indicates a normal condition (i.e. does not indicate the abnormal condition), it means the processing circuit 11 has read the first identification data from the display, and the first processing device 1 is able to recognize the first identification data. Then, in response to the reading condition not indicating the abnormal condition, the processing circuit 11 may use the first identification data as the second identification data. On the contrary, if the reading condition indicates the abnormal condition, then in response to the reading condition indicating the abnormal condition, the processing circuit 11 may use the predetermined identification data pre-stored by the processing circuit 11 as the second identification data. Therefore, under a situation where the abnormal condition occurs during the reading of the first identification data, the display may still normally display the display signal outputted by the second processing device subsequently, wherein the resolution indicated by the predetermined identification data may be the resolution that is widely used, for example, the resolution indicated by the predetermined identification data may be 600×400 pixels or 1024×768 pixels, but the present disclosure does not limit the resolution indicated by the predetermined identification data.

Figure 4A:
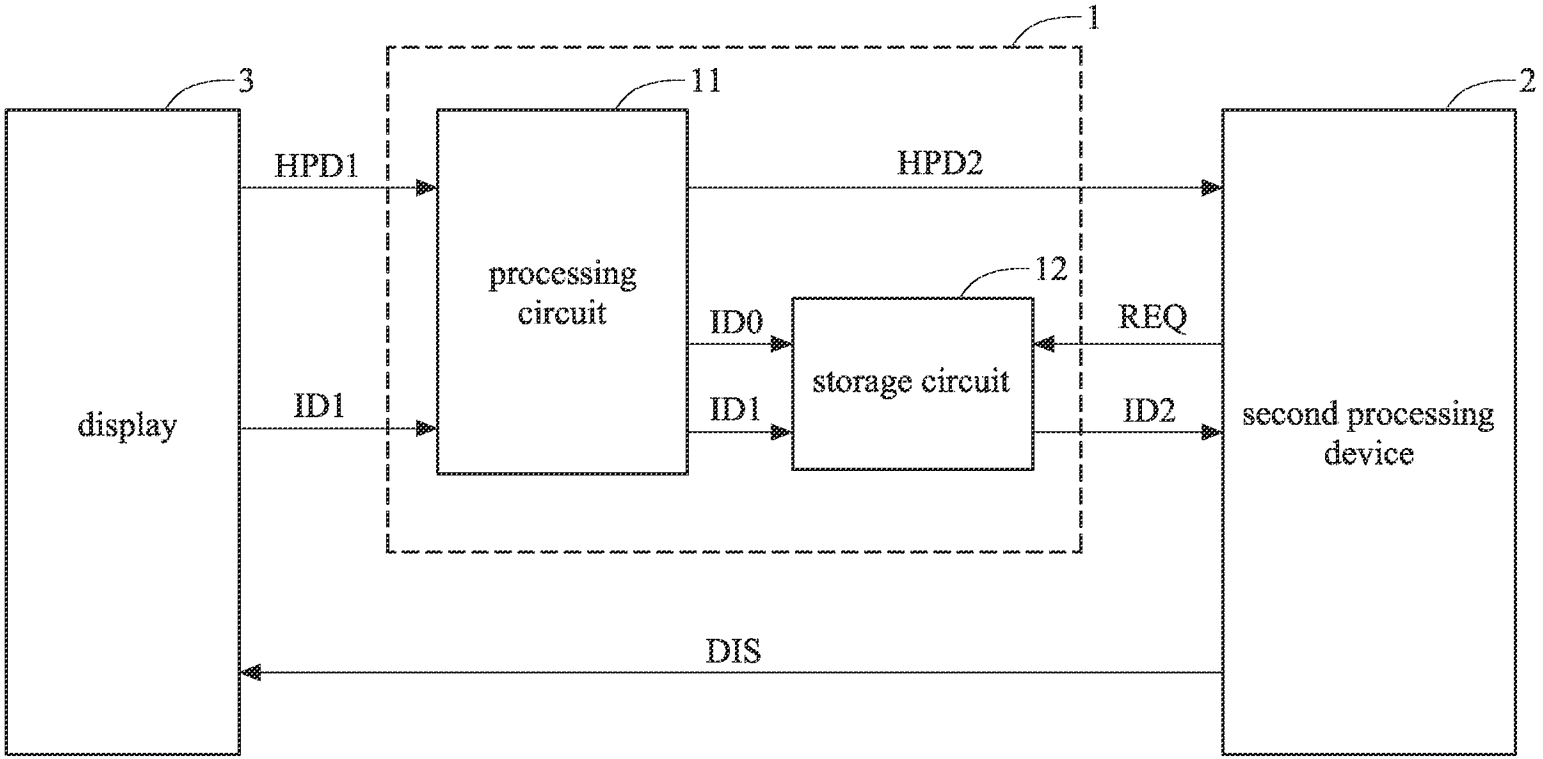
FIG. 4A is a schematic diagram illustrating the operation of the first processing device with the display and the second processing device.
Figure 4B:
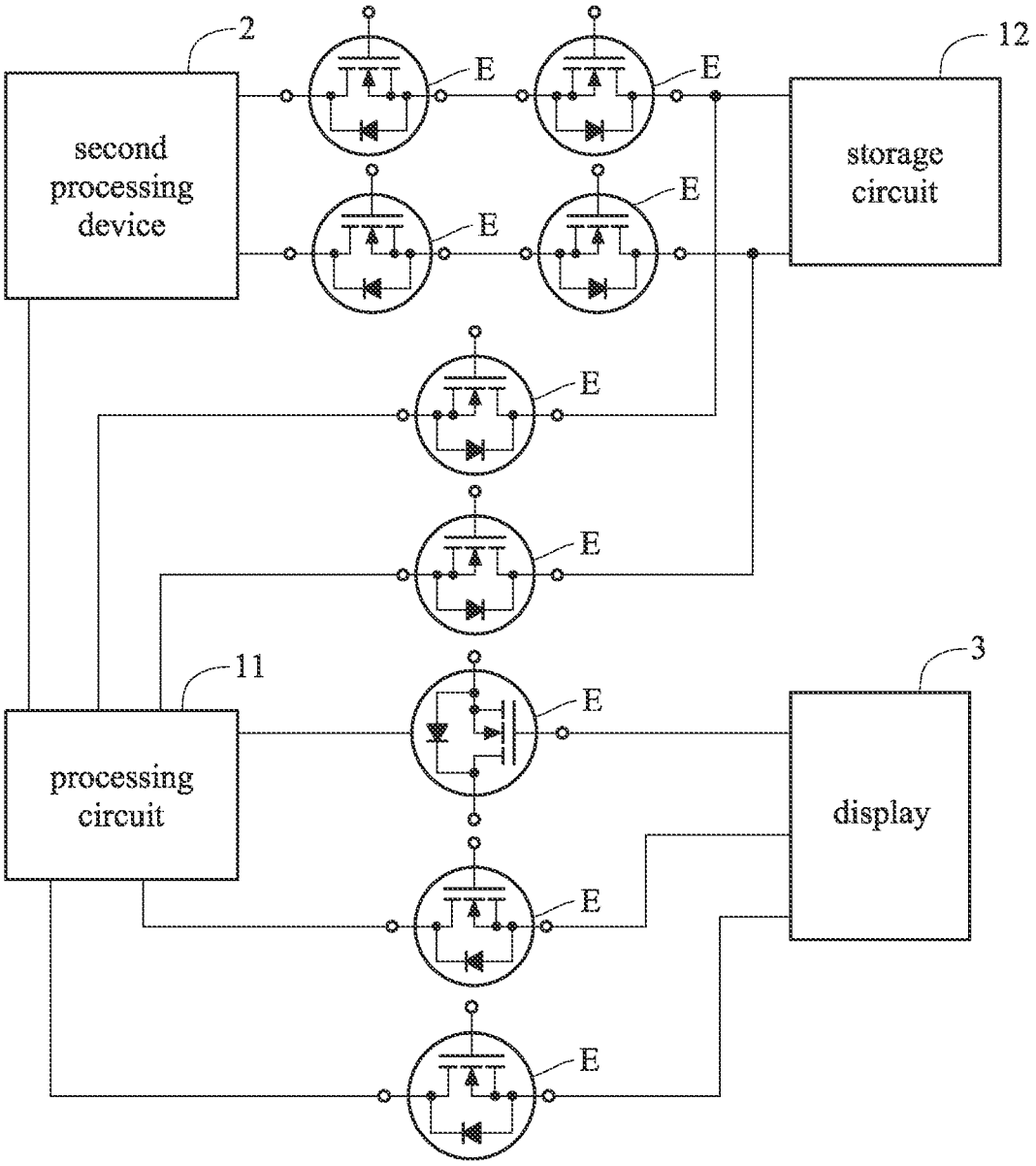
FIG. 4B illustrates a circuit diagram corresponding to FIG. 4A.

To explain the operation of the first processing device 1 with the display and the second processing device, please refer to FIG. 2, FIG. 3, FIG. 4A and FIG. 4B, wherein FIG. 4A is a schematic diagram illustrating the operation of the first processing device with the display and the second processing device, and the embodiment of FIG. 4A is adapted to a structure of the processing circuit 11 and the storage circuit 12 are separately disposed, and FIG. 4B illustrates a circuit diagram corresponding to FIG. 4A.

As shown in FIG. 4A and FIG. 4B, the processing circuit 11 is connected to the storage circuit 12, the second processing device 2 and the display 3, wherein the second processing device 2 may be the central processing unit of the computer as described above, and the display 3 may be the external display as described above. Further, the processing circuit 11 may be electrically connected to the storage circuit 12 through a number of electrical components E, wherein the electrical components E may include N-channel metal-oxide semiconductor transistors and pull down resistors. Similarly, the processing circuit 11 may be electrically connected to the display 3 through a number of electrical components E, and the storage circuit 12 may be electrically connected to the second processing device 2 through a number of electrical components E. In other words, the processing circuit 11 and the display 3 may communicate with each other through a first inter-integrated circuit bus; the processing circuit 11 and the storage circuit 12 may communicate with each other through a second inter-integrated circuit bus; the processing circuit 11 and the second processing device 2 may communicate with each other through a third inter-integrated circuit bus; the storage circuit 12 and the second processing device 2 may communicate with each other through a display data channel (DDC); and the second processing device 2 and the display 3 may communicate with each other through a digital display interface.

In step 51 and S3 of FIG. 2, the processing circuit 11, after triggered by the first detection signal HPD1 coming from the display 3, the processing circuit 11 reads the first identification data of the display 3 through the first inter-integrated circuit bus and determines whether the reading condition indicates the abnormal condition (step S31). If the reading condition does not indicate the abnormal condition, the processing circuit 11 uses the first identification data ID1 read from the display 3 as the second identification data ID2 (step S33), and stores the second identification data ID2 into the storage circuit 12 through the second inter-integrated circuit bus. On the contrary, if the reading condition indicates the abnormal condition, it means an unexpected error may occur during the processing circuit 11 reading the first identification data, the processing circuit 11 may use the predetermined identification data ID0 pre-stored by the processing circuit 11 as the second identification data ID2 (step S35), and store the second identification data ID2 into the storage circuit 12 through the second inter-integrated circuit bus. In other words, in response to the reading condition does not indicate the abnormal condition, the processing circuit 11 may use the first identification data ID1 read from the display 3 as the second identification data ID2; in response to the reading condition indicates the abnormal condition, the processing circuit 11 may use the predetermined identification data ID0 pre-stored by the processing circuit 11 as the second identification data ID2, and store the second identification data ID2 into the storage circuit 12 through the second inter-integrated circuit bus. In addition, in response to the reading condition indicates the abnormal condition, the processing circuit 11 may first re-try reading the first identification data, and use the predetermined identification data ID0 as the second identification data ID2 when the reading condition again indicates the abnormal condition.

Then, in step S5 of FIG. 2, the processing circuit 11 may output the second detection signal HPD2 to the second processing device 2, to notify the second processing device 2 that the second identification data ID2 (the first identification data ID1 or the predetermined identification data ID0) supported by the display 3 has been burnt into the storage circuit 12, thereby instructing the second processing device 2 to output the identification data request signal REQ to the storage circuit 12, wherein the identification data request signal REQ is used to request the second identification data ID2 stored in the storage circuit 12. Then, in step S7 of FIG. 2, the storage circuit 12 responds to the identification data request signal REQ and outputs the second identification data ID2 to the second processing device 2 through the display data channel, to instruct the second processing device 2 to output the display signal DIS corresponding to the resolution indicated by the second identification data ID2 through the digital display interface according to the resolution indicated by the second identification data ID2.

Figure 5:
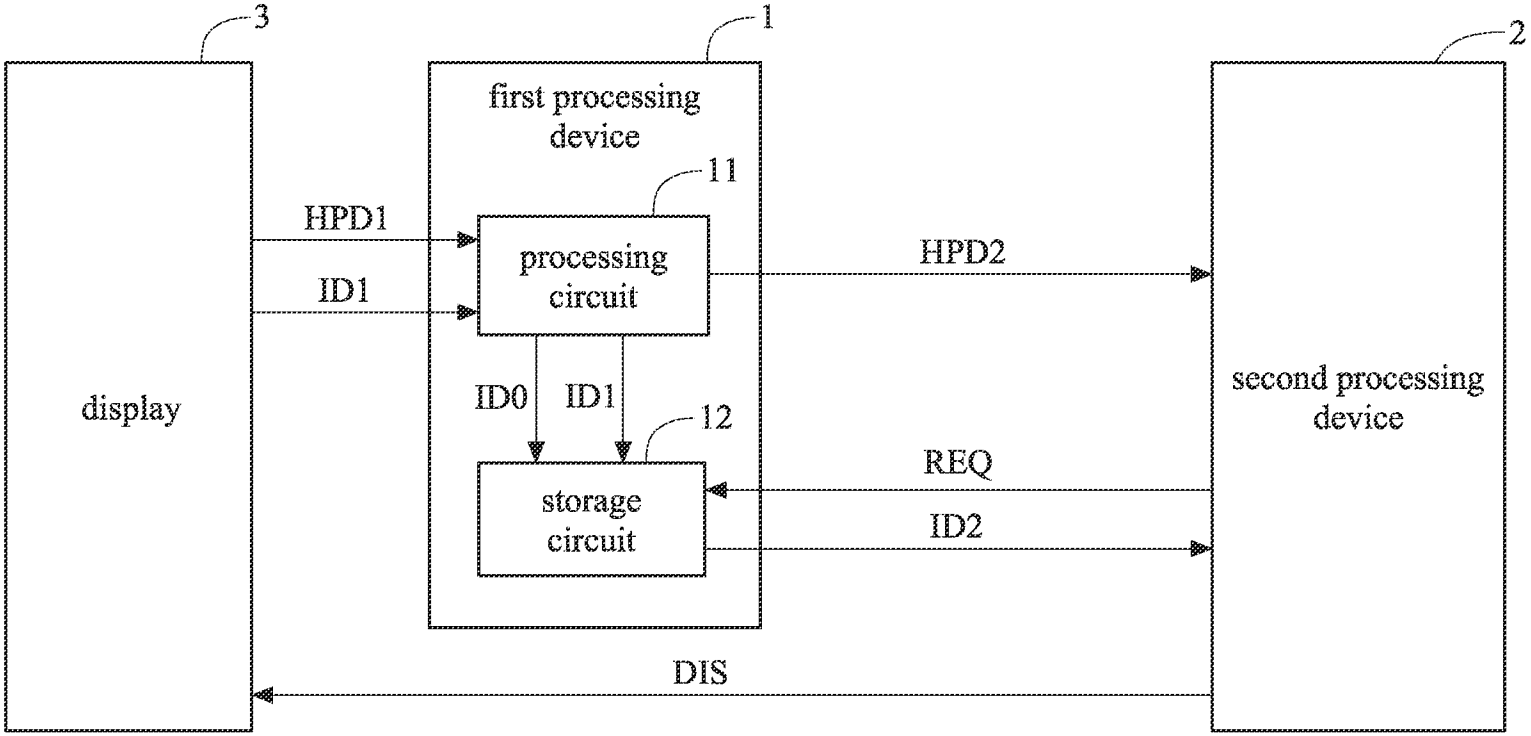
FIG. 5 is another schematic diagram illustrating the operation of the first processing device with the display and the second processing device.

To explain another type of operation of the first processing device 1 with the display and the second processing device in more detail, please refer to FIG. 2, FIG. 3 and FIG. 5, wherein FIG. 5 is another schematic diagram illustrating the operation of the first processing device with the display and the second processing device, and the embodiment of FIG. 5 is also adapted to a structure of the processing circuit 11 and the storage circuit 12 included in the same component (for example, the microcontroller unit). It should be noted that, in the embodiment of FIG. 5, circuit diagram of the processing circuit 11, the storage circuit 12, the second processing device 2 and the display 3 is similar to the circuit diagram of FIG. 4B. The differences between the circuit diagram for the embodiment of FIG. 5 and the circuit diagram of FIG. 4B are that, the storage circuit 12 would be omitted from the circuit diagram corresponding to FIG. 5, and the processing circuit 11 is replaced by a component including the processing circuit 11 and the storage circuit 12 (for example, the microcontroller unit).

In step S1 and S3 of FIG. 2, the processing circuit 11, after triggered by the first detection signal HPD1 coming from the display 3, reads the first identification data of the display 3 through the first inter-integrated circuit bus and determines whether the reading condition indicates the abnormal condition (step S31). If the reading condition does not indicate the abnormal condition, the processing circuit 11 may use the first identification data ID1 read from the display 3 as the second identification data ID2 (step S33) and store the first identification data ID1 into the storage circuit 12. On the contrary, if the reading condition indicates the abnormal condition, it means an unexpected error may occur during the processing circuit 11 reading the first identification data, the processing circuit 11 may use the predetermined identification data ID0 pre-stored by the processing circuit 11 as the second identification data ID2 (step S35) and store the second identification data ID2 into the storage circuit 12. In addition, in response to the reading condition indicates the abnormal condition, the processing circuit 11 may first re-try reading the first identification data, and use the predetermined identification data ID0 as the second identification data ID2 when the reading condition again indicates the abnormal condition.

Then, in step S5 of FIG. 2, the processing circuit 11 may output the second detection signal HPD2 to the second processing device 2 to notify the second processing device 2 that the second identification data ID2 (the first identification data ID1 or the predetermined identification data ID0) supported by the display 3 has been burnt into the storage circuit 12, thereby instructing the second processing device 2 to output the identification data request signal REQ to the storage circuit 12, wherein the identification data request signal REQ is used to request the second identification data ID2 stored in the storage circuit 12. Then, in step S7 of FIG. 2, the storage circuit 12 responds to the identification data request signal REQ and outputs the second identification data ID2 to the second processing device 2 through the display data channel, to instruct the second processing device 2 to output the display signal DIS corresponding to the resolution indicated by the second identification data ID2 through the digital display interface according to the resolution indicated by the second identification data ID2. Said resolution is the resolution supported by the display 3.

In addition, in another embodiment, except for the operations described in the above embodiments, the first processing device may store a number of pieces of predetermined identification data, and the identification data request signal is a command inputted through the Basic Input/output System (BIOS) of the second processing device by a user. Step S5 of FIG. 2 may include selecting one of the pieces of predetermined identification data according to the identification data request signal. In other words, the identification data request signal indicates the predetermined identification data specified by the user, and the identification data request signal may be generated based on the command inputted to the second processing device by the user through the BIOS. Therefore, after receiving the identification data request signal, the first processing device may use the predetermined identification data specified by the user as the second identification data. Accordingly, the resolution of the display may be more in line with the needs of the user.

In yet another embodiment, except for the operations described in the above embodiments, the processing circuit of the first processing device may further perform a monitoring procedure to obtain power-on condition record of the display, and may output the power-on condition record of the display to the second processing device when obtaining a condition record request signal associated with the display from the second processing device.

Figure 6A:
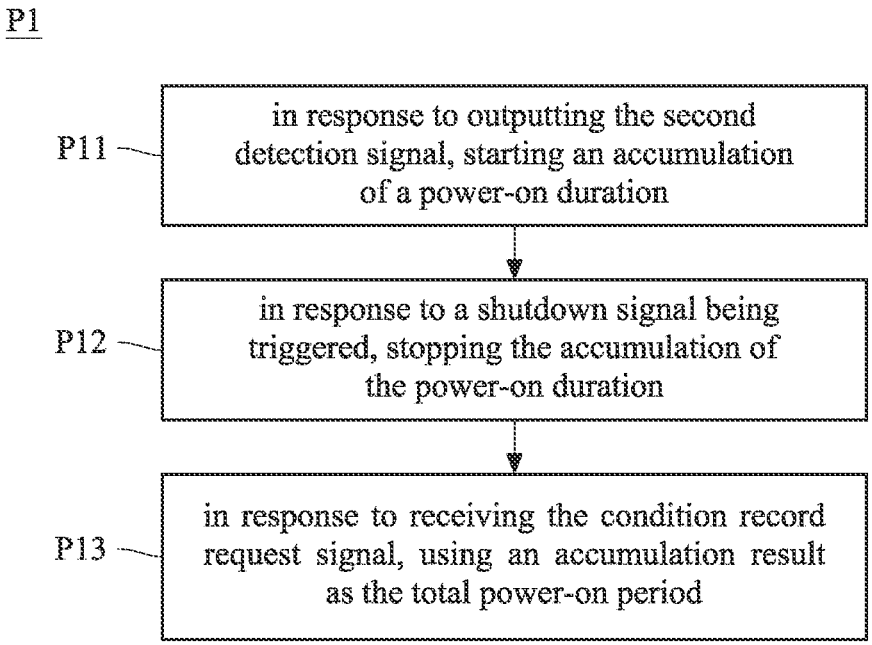
FIG. 6A illustrates a monitoring procedure according to an embodiment of the present disclosure.

To explain the monitoring procedure in more detail, please refer to FIG. 1 and FIG. 6A, wherein FIG. 6A illustrates a monitoring procedure according to an embodiment of the present disclosure. In this embodiment, the power-on condition record is a total power-on period (for example, power-on hour (POH)). As shown in FIG. 6A, the monitoring procedure P1 may include: step P11: in response to outputting the second detection signal, starting an accumulation of a power-on duration; step P12: in response to a shutdown signal being triggered, stopping the accumulation of the power-on duration; and step P13: in response to receiving the condition record request signal, using an accumulation result as the total power-on period.

The processing circuit 11 outputting the second detection signal means the available identification data (indicating the resolution supported by the display) has been burnt into the storage circuit 12, and the display may start operation. Therefore, in step P11, the processing circuit 11 may start the accumulation of the power-on duration. In step P12, when the processing circuit 11 is triggered by the shutdown signal, it means the second processing device stops providing display content to the display, and the display stops operating. Therefore, the processing circuit 11 may stop the accumulation of the power-on period, and using the accumulation result (i.e. the power-on period accumulated so far) as the total power-on period of the power-on condition record when receiving the condition record request signal. In other words, step P11 and step S5 of FIG. 2 may be performed at the same time, and the processing circuit 11 may perform step P11 and step P12 for multiple times, store the accumulation result into the storage circuit 12 after performing step P12 every time, and use the power-on duration accumulated so far (the accumulation result) as the total power-on period of the power-on condition record when receiving the condition record request signal.

Figure 6B:
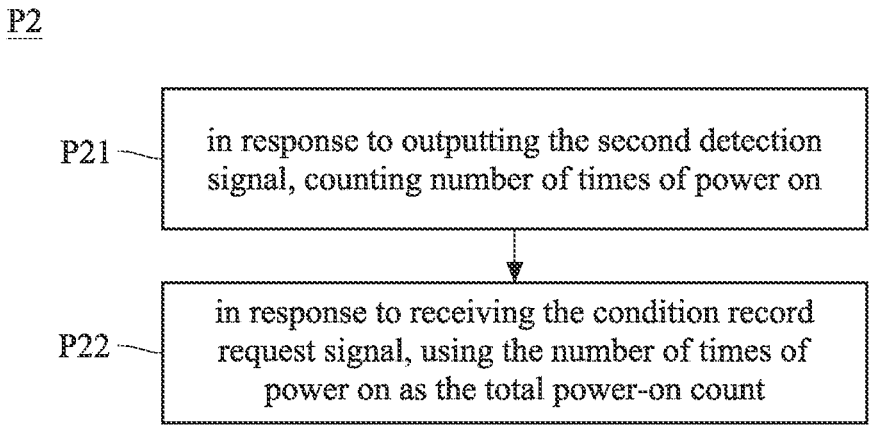
FIG. 6B illustrates another monitoring procedure according to an embodiment of the present disclosure.

Similarly, to explain the monitoring procedure in more detail, please refer to FIG. 1 and FIG. 6B, wherein FIG. 6B illustrates another monitoring procedure according to an embodiment of the present disclosure. In this embodiment, the power-on condition record is a total power-on count, wherein a total power-on count indicates a total number of times that the display is powered-on. As shown in FIG. 6B, the monitoring procedure P2 may include: step P21: in response to outputting the second detection signal, counting number of times of power on; and step P22: in response to receiving the condition record request signal, using the number of times of power on as the total power-on count.

As described above, the processing circuit 11 outputting the second detection signal means the available identification data (indicating the resolution supported by the display) has been burnt into the storage circuit 12, and the display may display the display signal outputted by the second processing device. Therefore, the processing circuit 11 may count the number of times of power on by increasing the power-on count of the display, meaning add "1" to the power-on count. The processing circuit 11 may perform step P21, and use the power-on count accumulated so far as the total power-on count of the power-on condition record when receiving the condition record request signal. In other words, step P21 and step S5 of FIG. 2 may be performed at the same time, and the processing circuit 11 may perform step P21 for multiple times, store the accumulated power-on count into the storage circuit 12 after performing step P21 every time, and use the power-on count accumulated so far stored in the storage circuit 12 as the total power-on count of the power-on condition record when receiving the condition record request signal.

It should be noted that, the power-on condition record obtained by the processing circuit 11 may include both the total power-on count and the total power-on period. That is, steps shown in FIG. 6A and steps shown in FIG. 6B may be performed at the same time, the present disclosure is not limited thereto. Accordingly, the second processing device may read the power-on condition record from the storage circuit 12 through the display data channel, for a user of the second processing device to monitor the usage status and service life of the display, for the user to determine whether the display should be replaced in advance or other related solutions should be implemented to prevent damage to the display.

Figure 7:
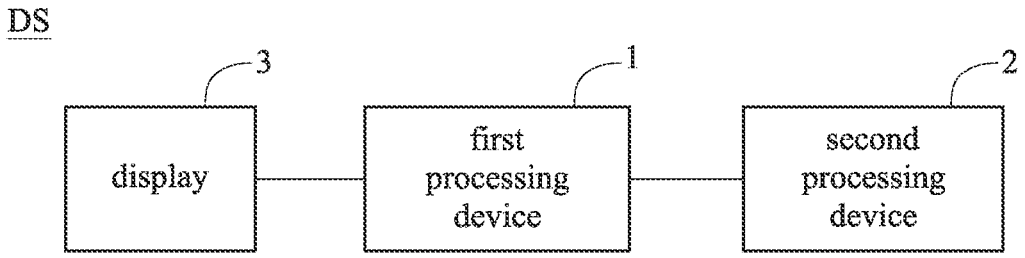
FIG. 7 illustrates a display system according to an embodiment of the present disclosure.

Please refer to FIG. 7, wherein FIG. 7 illustrates a display system according to an embodiment of the present disclosure. The display system DS includes the first processing device 1, the second processing device 2 and the display 3, wherein the first processing device 1 is directly electrically connected to the second processing device 2 and the display 3. The first processing device 1 is implemented with embodiments of the first processing device 1 of FIG. 4A or FIG. 5, and is configured to perform steps of FIG. 2, FIG. 3, FIG. 6A and FIG. 6B; the second processing device 2 may be the central processing unit of the computer as described above; the display 3 may be the external display connected to the computer disposed with the second processing device 2 as described above, and is configured to display the corresponding display content according to the display signal outputted by the second processing device 2.

For the embodiment of FIG. 2, the implementation performed by the display system DS of FIG. 7 is described as follows. After the display 3 is connected to the first processing device 1, the display 3 may output the first detection signal, the first processing device 1 is triggered by the first detection signal outputted by the display 3 to read the first identification data of the display 3 and obtain the second identification data according to the reading condition, wherein the generation of the first detection signal indicates the display 3 has been connected to the second processing device 2 through digital display interface. The first processing device 1 then outputs the second detection signal to the second processing device 2, and the second processing device 2 outputs the identification data request signal to the first processing device 1 to request the resolution supported by the display 3 from the first processing device 1. Then, the first processing device 1 outputs the second identification data to the second processing device 2 according to the identification data request signal, and the second processing device 2 outputs the display signal to the display 3 according to the resolution indicated by the second identification data. The embodiment of FIG. 2 has been described above, and is not described in detail herein.

For the embodiment of FIG. 3, the implementation performed by the display system DS of FIG. 7 is described as follows. The first processing device 1 reading the first identification data of the display 3 and obtaining the second identification data according to the reading condition means: the first processing device 1 determining whether the reading condition when reading the first identification data indicates the abnormal condition, if the reading condition indicates the abnormal condition, the first processing device 1 uses the predetermined identification data pre-stored by the first processing device 1 as the second identification data; if the reading condition does not indicate the abnormal condition, it means the first processing device 1 reads the usable first identification data from the display 3, and the first processing device 1 uses the first identification data as the second identification data. The embodiment of FIG. 3 has been described above, and is not described in detail herein.

In addition, as described above, the first processing device 1 may pre-store a number of pieces of predetermined identification data, the second processing device 2 may have a BIOS, and the identification data request signal outputted by the second processing device 2 to the first processing device 1 may be generated based on the command inputted to the BIOS by a user. Therefore, after receiving the identification data request signal, the first processing device 1 may select one of the pieces of predetermined identification data as the second identification data accordingly.

For the embodiment of FIG. 6A, the implementation performed by the display system DS of FIG. 7 is described as follows. The first processing device 1 starts accumulating a power-on duration when outputting the second detection signal, and stops the accumulation of the power-on period when triggered by the shutdown signal. When the second processing device 2 outputs the condition record request signal to the first processing device 1, the first processing device 1 uses the accumulation result as the total power-on period when receiving the condition record request signal, and outputs the total power-on period to the second processing device 2. The embodiment of FIG. 6A has been described above, and is not described in detail herein.

For the embodiment of FIG. 6B, the implementation performed by the display system DS of FIG. 7 is described as follows. The first processing device 1 increases a power-on count when outputting the second detection signal. When the second processing device 2 outputs the condition record request signal to the first processing device 1, the first processing device 1 uses the accumulated power-on count as the total power-on count when receiving the condition record request signal, and outputs the total power-on count to the second processing device 2. The embodiment of FIG. 6B has been described above, and is not described in detail herein.

In view of the above description, according to the method of providing display signal, the resolution setting device and the display system of one or more embodiments of the present disclosure, even if the external display is installed with an adapter but the adapter is not compatible with the display or the computer, the display may still display the display signal outputted by the computer with the resolution supported by the display. In addition, according to the method of providing display signal, the resolution setting device and the display system of one or more embodiments of the present disclosure, the resolution of the display may be more in line with the needs of the user, and the user may monitor the usage status and service life of the display according to the power-on condition record, for the user to determine whether the display should be replaced in advance or other related solutions should be implemented to prevent damage to the display.

What is claimed is:

1. A method of providing display signal, performed by a first processing device, and the method comprising:

triggered by a first detection signal for reading first identification data of a display;

obtaining second identification data according to a reading condition;

outputting a second detection signal to a second processing device for obtaining an identification data request signal from the second processing device; and outputting the second identification data to the second processing device according to the identification data request signal for instructing the second processing device to output a display signal to the display according to a resolution indicated by the second identification data.

2. The method of providing display signal according to claim 1, wherein obtaining the second identification data according to the reading condition comprises:

in response to the reading condition indicating an abnormal condition, using predetermined identification data as the second identification data.

3. The method of providing display signal according to claim 1, wherein obtaining the second identification data according to the reading condition further comprises:

in response to the reading condition indicating a normal condition, using the first identification data as the second identification data.

4. The method of providing display signal according to claim 2, wherein the abnormal condition comprises:

reading no the first identification data from the display; or determining the first processing device not being able to recognize the first identification data according to the first identification data.

5. The method of providing display signal according to claim 1, further comprising:

obtaining, from the second processing device, a condition record request signal associated with the display; and outputting, according to the condition record request signal, a power-on condition record to the second processing device.

6. The method of providing display signal according to claim 5, wherein the power-on condition record comprises a total power-on period, and the method further comprises:

in response to outputting the second detection signal, starting an accumulation of a power-on duration;

in response to a shutdown signal being triggered, stopping the accumulation of the power-on duration; and in response to receiving the condition record request signal, using an accumulation result as the total power-on period.

7. The method of providing display signal according to claim 5, wherein the power-on condition record comprises a total power-on count, and the method further comprises:

in response to outputting the second detection signal, counting number of times of power on; and in response to receiving the condition record request signal, using the number of times of power on as the total power-on count.

8. The method of providing display signal according to claim 1, wherein the first processing device stores a plurality of pieces of predetermined identification data, and outputting the second identification data to the second processing device according to the identification data request signal comprises:

selecting one of the pieces of predetermined identification data as the second identification data according to the identification data request signal.

9. A resolution setting device, comprising:

a processing circuit being triggered by a first detection signal for reading first identification data of a display and obtaining second identification data according to a reading condition, and outputting a second detection signal to a processing device; and a storage circuit connected to the processing circuit, receiving the second identification data from the processing circuit and storing the second identification data, obtaining an identification data request signal in response to the second detection signal from the processing device, and outputting the second identification data to the processing device according to the identification data request signal, for the processing device outputting a display signal to the display according to a resolution indicated by the second identification data.

10. The resolution setting device according to claim 9, wherein in response to the reading condition indicating an abnormal condition, the processing circuit uses predetermined identification data as the second identification data.

11. The resolution setting device according to claim 10, wherein the abnormal condition comprises: the processing circuit reading no the first identification data from the display; or the processing circuit determining the processing circuit not being able to recognize the first identification data according to the first identification data.

12. The resolution setting device according to claim 9, wherein the storage circuit is electrically connected to the processing circuit through an inter-integrated circuit bus.

13. The resolution setting device according to claim 9, wherein the storage circuit is disposed at a microcontroller unit along with the processing circuit.

14. The resolution setting device according to claim 9, wherein the processing circuit further obtains a condition record request signal associated with the display from the processing device, and outputs a power-on condition record associated with the display to the processing device according to the condition record request signal.

15. The resolution setting device according to claim 14, wherein the power-on condition record comprises a total power-on period, the processing circuit starts accumulating a power-on duration in response to outputting the second detection signal, stops accumulating the power-on duration in response to being triggered by a shutdown signal, and uses an accumulation result as the total power-on period in response to receiving the condition record request signal.

16. The resolution setting device according to claim 14, wherein the power-on condition record comprises a total power-on count, the processing circuit counts number of times of power on in response to outputting the second detection signal, and uses the number of times of power-on as the total power-on count in response to receiving the condition record request signal.

17. The resolution setting device according to claim 9, wherein the processing circuit pre-stores a plurality of pieces of predetermined identification data, and the processing circuit selects one of the pieces of predetermined identification data as the second identification data according to the identification data request signal.

18. A display system, comprising:

a display displaying a display content according to a display signal;

a first processing device connected to the display, and being triggered by a first detection signal to read first identification data of a display and obtain second identification data according to a reading condition, outputting a second detection signal to obtain an identification data request signal in response to the second detection signal, and outputting the second identification data according to the identification data request signal; and a second processing device connected to the display and the first processing device, and outputting the identification data request signal to the first processing device according to the second detection signal, reading the second identification data from the first processing device, and outputting the display signal to the display according to a resolution indicated by the second identification data.

19. The display system according to claim 18, wherein the first processing device comprises:

a processing circuit being triggered by the first detection signal for reading the first identification data of the display and obtaining the second identification data according to the reading condition, and outputting the second detection signal; and a storage circuit connected to the processing circuit, receiving the second identification data from the processing circuit and storing the second identification data, obtaining the identification data request signal in response to the second detection signal, and outputting the second identification data according to the identification data request signal.

20. The display system according to claim 19, wherein in response to the reading condition indicating an abnormal condition, the processing circuit uses predetermined identification data as the second identification data.

* * * * *